US011459675B2

(12) United States Patent
Zhou

(10) Patent No.: US 11,459,675 B2
(45) Date of Patent: Oct. 4, 2022

(54) SECONDARY IMPURITY-REMOVAL RECYCLING SYSTEM FOR REFINING COTTON

(71) Applicant: HUBEI JINHANJIANG REFINED COTTON CO., LTD, Hubei (CN)

(72) Inventor: Hangxu Zhou, Hubei (CN)

(73) Assignee: HUBEI JINHANJIANG REFINED COTTON CO., LTD.

( * ) Notice: Subject to any disclaimer, the term of this patent is extended or adjusted under 35 U.S.C. 154(b) by 0 days.

(21) Appl. No.: 17/158,001

(22) Filed: Jan. 26, 2021

(65) Prior Publication Data

US 2022/0042211 A1 Feb. 10, 2022

(30) Foreign Application Priority Data

Aug. 6, 2020 (CN) ..... 202021616050.X

(51) Int. Cl.

| | |
|---|---|
| ***D01G 9/10*** | (2006.01) |
| ***D01G 9/20*** | (2006.01) |
| ***D01G 9/18*** | (2006.01) |
| ***D01B 1/02*** | (2006.01) |
| ***B07B 1/42*** | (2006.01) |

(52) U.S. Cl.

CPC ..... *D01G 9/10* (2013.01); *B07B 1/42* (2013.01); *D01B 1/02* (2013.01); *D01G 9/18* (2013.01); *D01G 9/20* (2013.01)

(58) Field of Classification Search

CPC ... D01B 1/04; D01G 9/00; D01G 9/06; D01G 9/08; D01G 9/10; D01G 9/12; D01G 9/14; D01G 9/18; D01G 9/22; B07B 1/00; B07B 4/08

USPC ..... 19/40, 41, 107, 200, 204; 55/315; 241/24.21

See application file for complete search history.

(56) References Cited

U.S. PATENT DOCUMENTS 876,576 A * 1/1908 McDonald ..... D01G 9/00 19/93
1,401,439 A * 12/1921 Pettit ..... D01B 1/04 19/80 R (Continued)

FOREIGN PATENT DOCUMENTS

CN 201186966 Y * 1/2009
CN 101705540 A 5/2010

(Continued)

*Primary Examiner* — Khoa D Huynh
*Assistant Examiner* — Aiying Zhao

(57) ABSTRACT

A secondary impurity-removal recycling system for refining cotton is provided. A first feeding opening is set on the side of the first bin shell, in which the first drum is movably installed, and the first drum is tube shaped. A first mesh is set on the peripheral wall of the first drum, and a first scraper is set at the first feeding opening inside the first bin shell. One end of the first drum is provided with a first impurity-discharging pipe, the outer periphery of which is provided with a first annular hump. The first connecting sleeve is installed on the outer wall of the first bin shell, and the first impurity-discharging pipe is movably stuck in the first connecting sleeve through the first annular hump, and communicates with the first connecting sleeve. The first induced draft fan communicates with the first connecting sleeve through a first air duct.

14 Claims, 11 Drawing Sheets

(56) References Cited

U.S. PATENT DOCUMENTS

| | | | | | |
|---|---|---|---|---|---|
| 1,721,932 | A * | 7/1929 | Streun | D01B 1/04 19/37 |
| 3,432,892 | A * | 3/1969 | Case | D01G 9/00 19/203 |
| 4,300,267 | A * | 11/1981 | Winch | D01G 9/00 19/107 |
| 4,974,293 | A * | 12/1990 | Baker | D01B 1/02 19/37 |
| 2011/0284432 | A1* | 11/2011 | Van den Hurk | A01F 29/005 209/643 |
| 2018/0266020 | A1* | 9/2018 | Zhou | B01D 50/002 |

FOREIGN PATENT DOCUMENTS

| | | | | |
|---|---|---|---|---|
| CN | 202683488 | U | * | 1/2013 |
| CN | 203513845 | U | * | 4/2014 |
| CN | 205035517 | U | | 2/2016 |
| CN | 106544761 | A | * | 3/2017 |
| CN | 206015407 | U | | 3/2017 |
| CN | 108708002 | A | * | 10/2018 |
| CN | 109868509 | A | * | 6/2019 |
| GB | 730149 | A | * | 5/1955 ..... D01G 9/00 |

* cited by examiner

SECONDARY IMPURITY-REMOVAL RECYCLING SYSTEM FOR REFINING COTTON

FIELD

The present invention relates to the technical field of impurity-removal devices, more specifically to the technical field of a secondary impurity-removal recycling device for refining cotton.

BACKGROUND

Refined cotton is white cotton fibre made of cotton linters after processing and being refined, known as a special industrial additive. As raw cotton linters are the fibre that is stripped by a delinter from short fibre on cotton seeds, the fibre is often mixed with impurities such as cotton seed hulls, sand, cotton dust, iron filings, etc., so it is particularly important to remove such impurities during the production process. The removed impurities still contain some raw cotton linters, after impurity-removal was only performed once. If the secondary impurity-removal is not performed, some raw materials will be wasted, which will increase production costs and reduce operating benefits. The secondary impurity-removal generally comprises drum impurity-removal, rods-and-trips impurity-removal and linter-cleaning impurity-removal, at present, the various impurity-removal device involved in the secondary impurity-removal process has many shortcomings.

Among them, the impurity-removal effect of traditional drum impurity-removal device is not very satisfactory, and the cotton linters after the impurity-removal still contain more impurities, which does not facilitate subsequent processing of cotton linters and adversely affects the quality of the final refined cotton.

The traditional rods-and-trips impurity-removal device has the following shortcomings. As it is easy to agglomerate the cotton linters entering the rods-and-trips impurity-removal device, the impurities contained in the cotton linters cannot be fully scattered out, thereby seriously influencing the impurity-removal effect.

The traditional linter-cleaning impurity-removal device has the following shortcomings. First, the linter-cleaning impurity-removal device generally adopts drum impurity-removal, during the impurity-removal process, the impurities in the outer layer of cotton linters cannot enter the drum through the mesh of the drum, and will be directly scraped off and sent into the next step, so that the impurities are not effectively removed, and the impurity-removal effect is not very satisfactory. Second, as the last step of the secondary impurity-removal, since the impurities in the cotton linters are generally very small, and the mesh hole of the drum is also small, so that the mesh holes of the drum are easily blocked by impurities or cotton fibre, which needs to clean the mesh, and yet by traditional way of cleaning them, staffs blow the drum using a blowing pipe, thus increasing the staffs' labour intensity.

SUMMARY

The object of the present invention is to solve the shortcomings of the traditional device and provide a secondary impurity-removal recycling system for refining cotton that can improve the impurity-removal effect, reduce the impurity content in the cotton linters after removing impurities, facilitate the subsequent processing of the cotton linters and lighten the staffs' labour.

In order to solve the above-mentioned technical problem, the technical solutions adopted in the present invention are as follows.

A secondary impurity-removal recycling system for refining cotton comprises a drum impurity-removal mechanism, a rods-and-trips impurity-removal mechanism and a linter-cleaning impurity-removal mechanism. The drum impurity-removal mechanism comprises a first bin shell, a first induced draft fan, a second induced draft fan, a first drum, a first motor, a second motor, a first connecting sleeve and a first rotary shaft. A first feeding opening is set on the side of the first bin shell, in which the first drum is movably installed, and the first drum is tube shaped. A first mesh is set on the peripheral wall of the first drum, and a first scraper is set at the first feeding opening inside the first bin shell, opposite the outer peripheral wall of the first drum. One end of the first drum is provided with a first impurity-discharging pipe, the outer periphery of which is provided with a first annular hump. The first connecting sleeve is fixedly installed on the outer wall of the first bin shell, and the first impurity-discharging pipe is movably stuck in the first connecting sleeve through the first annular hump, and communicates with the first connecting sleeve. The first induced draft fan communicates with the first connecting sleeve through a first air duct, and the first motor is drivingly connected with the first drum. A discharging pipe is set at the bottom of the first bin shell, and arc plates having the same centre and the same radius are set on the two side walls of the discharging pipe, respectively. A impurity-absorbing cavity is set on the outside of the arc plate on one side, and a second mesh communicating with the impurity-absorbing cavity is set on the arc plate. An impurity-outlet is set on the outer side wall of the impurity-absorbing cavity, and the second induced draft fan is connected to the impurity-outlet through a second air duct. The first rotary shaft is movably inserted in the discharging pipe, and a second scraper is set on the first rotary shaft, opposite the inner side wall of the arc plate. The second motor is drivingly connected with the first rotary shaft. The rods-and-trips impurity-removal mechanism comprises a base, a vibrating sieve bin, a spring, a vibrating motor, a hollow axis tube, a second connecting sleeve, a second sealing ring, a high-pressure blower, a third motor, a hollow body, a second rotary shaft, a fourth motor, a canvas tube and a hose. A supporting column is set on the base, and a supporting frame is set on the vibrating sieve bin, and the supporting frame of the vibrating sieve bin is installed on the supporting column through the spring. The vibrating motor is fixedly installed on the vibrating sieve bin, and the vibrating sieve bin is provided with a second feeding opening and a discharging opening, and the second feeding opening communicates with the discharging pipe of the drum impurity-removal mechanism. Sieving holes are set on the bottom wall of the vibrating sieve bin, in which the hollow axis tube is movably inserted, and the hollow axis tube located in the vibrating sieve bin is provided with rods-and-trips spirally arranged and a spraying tube communicating with the inside of the hollow axis tube. The third motor is fixedly installed on the supporting frame, and is drivingly connected to the hollow axis tube, and the second connecting sleeve is fixedly installed on the vibrating sieve bin. A connecting head communicating with the inside of the hollow axis tube is set on one end of the hollow axis tube, and is movably stuck in the second connecting sleeve and communicates with the second connecting sleeve. The second sealing ring is fixedly stuck in the second connecting sleeve, which encircles the outside of the connecting head, and the high-pressure blower is fixedly installed on the base, and is connected to the second connecting sleeve through the hose. The hollow body is fixedly installed on the base, and is located under the vibrating sieve bin, and the top wall of the hollow body is provided with an impurity-inlet. The impurity-inlet of the hollow body is connected to the sieving holes of the vibrating sieve bin through the canvas tube, and an impurity-discharging opening is set at the bottom of the hollow body. The second rotary shaft is movably inserted in the hollow body, and a spiral rib plate is set on the second rotary shaft located in the hollow body. The fourth motor is fixedly installed on the base, and is drivingly connected with the second rotary shaft. The linter-cleaning impurity-removal mechanism comprises a frame, a second bin shell, a third induced draft fan, a second drum, a first licker-in, a second licker-in, a third licker-in, a pressuring roller, a bottom plate, a blowing pipe, a high-pressure air bag, a pulse valve, a fifth motor, a sixth motor, a seventh motor and a third connecting sleeve. The second bin shell is fixedly installed on the frame, and the bottom and the rear of the second bin shell are open. A third feeding opening is set on the top wall of the front of the second bin shell, and communicates with the discharging opening of the rods-and-trips impurity-removal mechanism. The first licker-in and the second licker-in are movably installed in the second bin shell, respectively, and the second licker-in is located at the third feeding opening of the second bin shell. A first spike and a second spike are set on the periphery of the first licker-in and the second licker-in, respectively. The fifth motor is drivingly connected with the first licker-in and the second licker-in, respectively. The bottom plate is fixedly installed in the second bin shell and is located under the first licker-in, and the bottom plate is provided with impurity-leaking holes. The second drum is movably installed in the second bin shell, and is tube shaped, and impurity-absorbing holes are set on the peripheral wall of the second drum. A third scraper opposite the outer peripheral wall of the second drum is set at the rear of the second bin shell, and a discharging hopper is set at the third scraper. A second impurity-discharging pipe is set at one end of the second drum, and a second annular hump is set on the outer periphery of the second impurity-discharging pipe. The third connecting sleeve is fixedly installed on the outer wall of the second bin shell, and the second impurity-discharging pipe is movably stuck in the third connecting sleeve through the second annular hump, and communicates with the third connecting sleeve. The third induced draft fan communicates with the third connecting sleeve through a third air duct, and the sixth motor is in drivingly connected with the second drum. The high-pressure gas bag is fixedly installed on the frame, and the pulse valve is fixedly installed on the high-pressure gas bag and communicates with the high-pressure gas bag. The blowing pipe communicates with the pulse valve, and is inserted in the second drum, and a spraying nozzle opposite the impurity-absorbing holes is set on the blowing pipe located in the second drum. The pressing roller is movably installed in the second bin shell and located above the second drum, and the third licker-in is movably installed in the second bin shell and located diagonally above the second drum. A third spike is set on the periphery of the third licker-in, and the seventh motor is drivingly connected with the third licker-in.

The drum impurity-removal mechanism further comprises a first sealing ring. The first sealing ring is fixedly stuck in the first connecting sleeve, and encircles the outside of the first annular hump.

the first drum (A4) is movably installed in the first bin shell (A1) through a first bearing (A11), the first motor (A5) is fixedly installed on the first bin shell (A1), a first gear (A17) is set on the other end of the first drum (A4), and a second gear (A18) is set on the output shaft of the first motor (A5), and meshes with the first gear (A17), the first rotary shaft (A9) is movably inserted in the discharging pipe (A19) through a second bearing (A25), the second motor (A6) is fixedly installed on the discharging pipe (A19), and the second motor (A6) is drivingly connected with the first rotary shaft (A9) through a coupling (A27).

The hollow axis tube is movably inserted in the vibrating sieve bin through a third bearing. A first belt pulley is set on the output shaft of the third motor, and a second belt pulley is set at the end of the hollow axis tube, and drivingly connected with the first belt pulley. The second rotary shaft is movably inserted in the hollow body through a fourth bearing. A third belt pulley is set on the output shaft of the fourth motor, and a fourth belt pulley is set at the end of the second rotary shaft, and is belt-drivingly connected with the third belt pulley.

The lower end of the spring is fixed on the supporting column, and the supporting frame is fixedly set on the upper end of the spring.

The second connecting sleeve is fixedly installed on the vibrating sieve bin by a supporting seat, and the hollow body is fixedly installed on the base by a supporting rod.

The first licker-in and the second licker-in are movably installed in the second bin shell through a fifth bearing and a sixth bearing, respectively, and a fifth belt pulley is set at one end of the first licker-in and the second licker-in, respectively. The first licker-in is belt-drivingly connected to the second licker-in with the fifth belt pulley. The fifth motor is fixedly installed on the second bin shell. A sixth belt pulley is set on the other end of the first licker-in, and a seventh belt pulley is set and the output shaft of the fifth motor, and is drivingly connected with the sixth belt pulley. The second drum is movably installed in the second bin shell through a seventh bearing, and the sixth motor is fixedly installed on the frame. A third gear is set on the other end of the second drum, and a fourth gear is set on the output shaft of the sixth motor, and meshes with the third gear. The pressuring roller is movably installed in the second bin shell through an eighth bearing, and the third licker-in is movably installed in the second bin shell through a ninth bearing. An eighth belt pulley is set at one end of the third licker-in, and the seventh motor is fixedly installed on the second bin shell. A ninth belt pulley is set on the output shaft of the seventh motor, and belt-drivingly connected with the eighth belt pulley.

The linter-cleaning impurity-removal mechanism further comprises a third sealing ring and a fourth sealing ring. The third sealing ring is fixedly stuck in the third connecting sleeve and encircles the outside of the second annular hump. A pipe sleeve is set on the second drum, and the blowing pipe is movably inserted through the pipe sleeve and the second drum through a tenth bearing. The fourth sealing ring is fixedly stuck in the pipe sleeve and encircles the outside of the blowing pipe.

The beneficial effects that the invention can achieve by adopting the above technical solutions are that:

1. After the drum impurity-removal mechanism removes impurities through the first drum, the cotton linters are adsorbed on the arc plate by the second induced draft fan, so that the impurities are sucked into the impurity-absorbed cavity through the second mesh, which improves the drum impurity-removal effect, fully facilitates the subsequent processing of cotton linters, and effectively improves the quality of the final refined cotton.

2. The rods-and-trips impurity-removal mechanism breaks and disperses the cotton linters through the rods-and-trips, at the same time, the high-pressure blower and the blowing pipe spray high-pressure air to blow away the cotton linters, to fully scatter the impurities in the cotton linters, then sieve them through the vibrating sieve bin driven by the vibrating motor, so that the impurities are shaken down and discharged from the sieving holes, which improves the impurity-removal effect.

3. The cotton linters adsorbed on the second drum are stripped by the third spike on the third licker-in, so that the thickness of the cotton layer on the second drum is maintained at a certain thickness to avoid inability to effectively remove the impurities in the outer cotton layer for too thick cotton layer, which improves the impurity-removal effect, and reduces the impurity content in the cotton linters after impurity-removal. When the impurity-absorbing holes of the second drum need to be cleaned, the compressed air in the high-pressure air bag is sprayed out through the blowing pipe and spraying nozzle, to backwards blow the impurity-absorbing holes, so that there is no need for manual cleaning, which reduces the staffs' work intensity.

DETAILED DESCRIPTION

Figure 1:
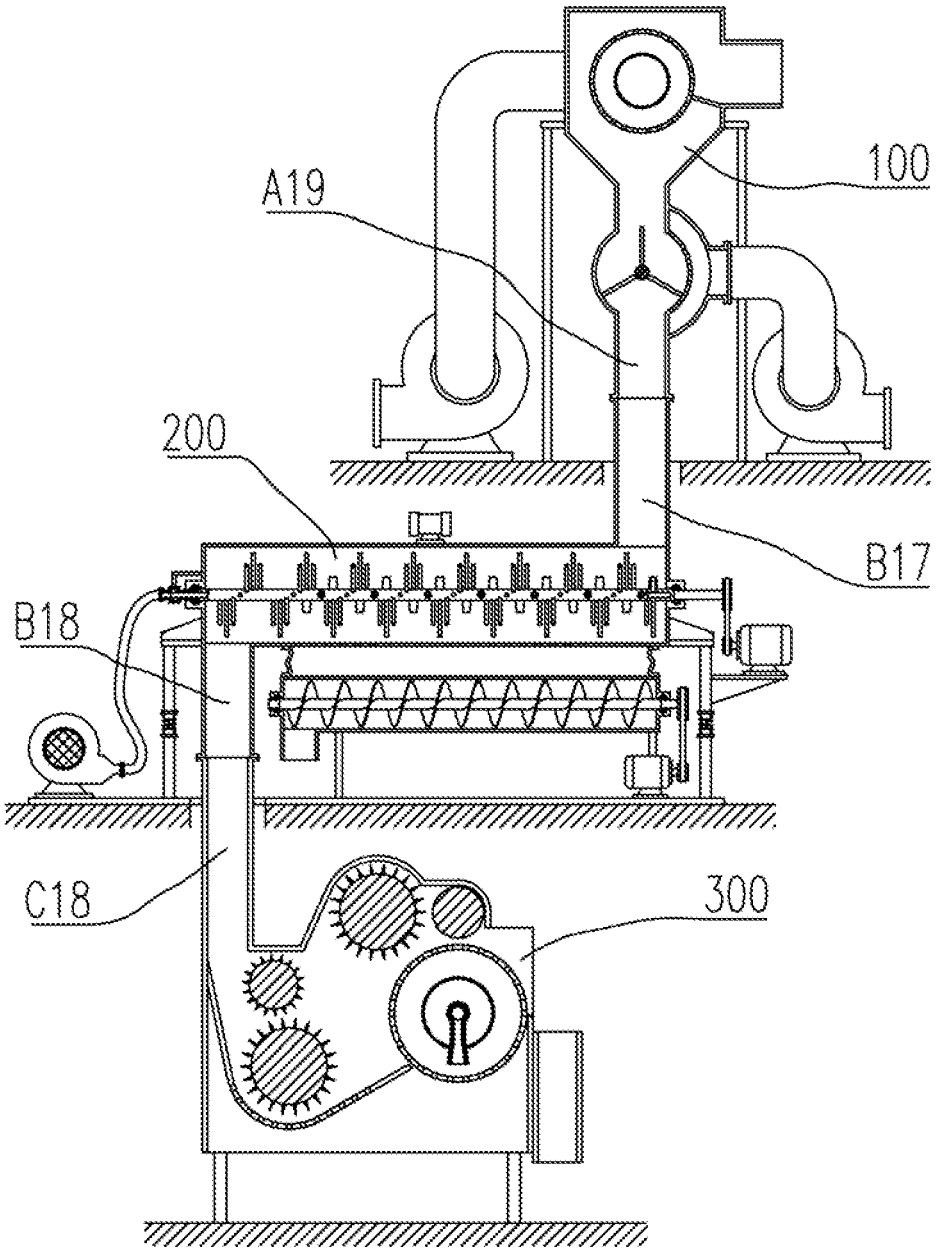
FIG. 1 is a schematic diagram of the invention.
Figure 2:
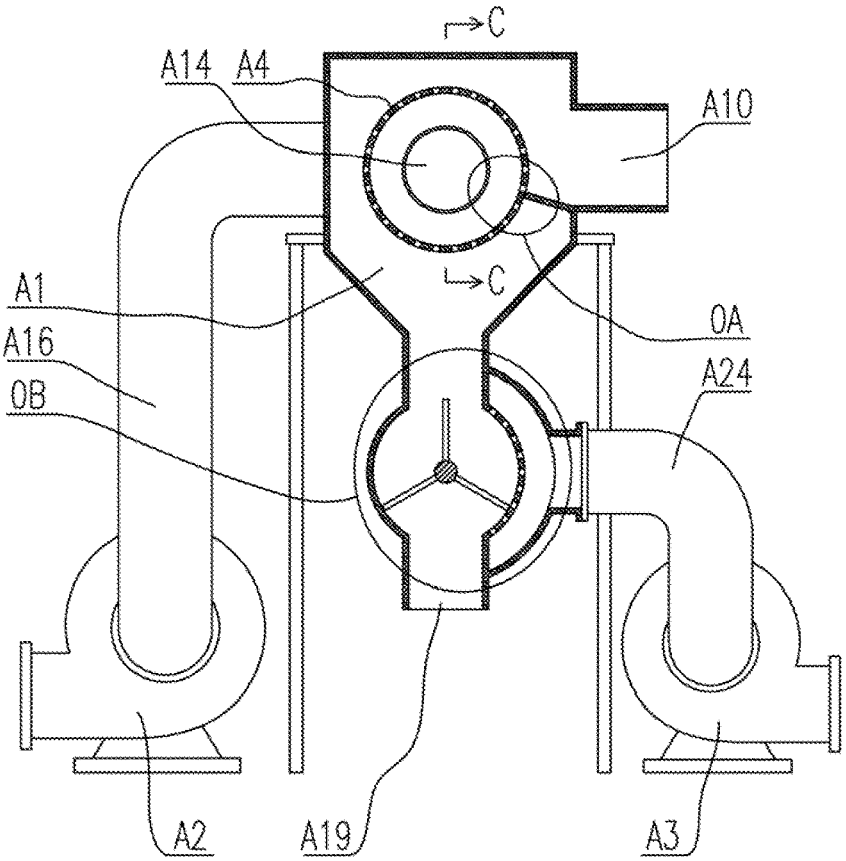
FIG. 2 is a schematic diagram of the drum impurity-removal mechanism.
Figure 3:
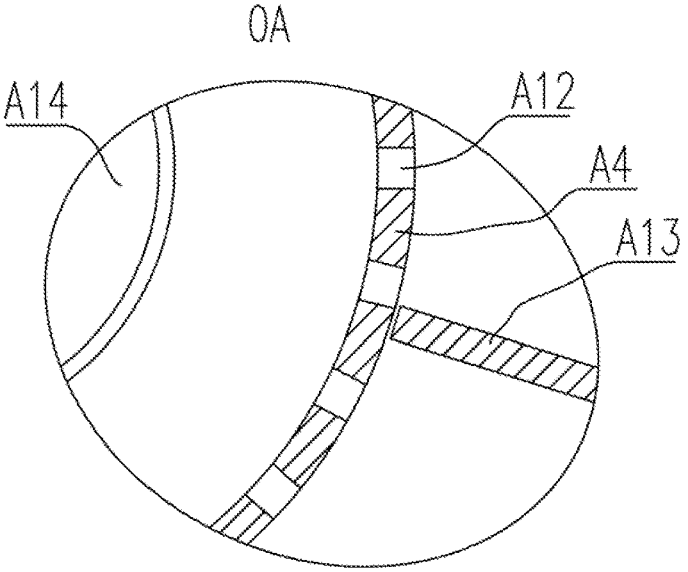
FIG. 3 is a partial enlarged schematic diagram at 0A in FIG. 2.
Figure 4:
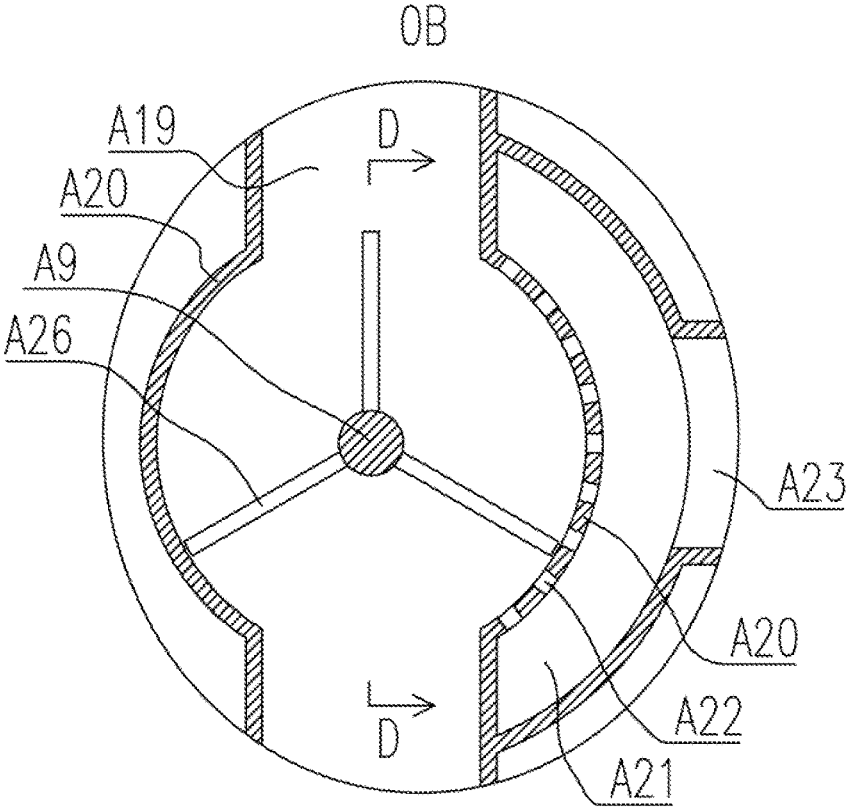
FIG. 4 is a partial enlarged schematic diagram at 0B in FIG. 2.
Figure 5:
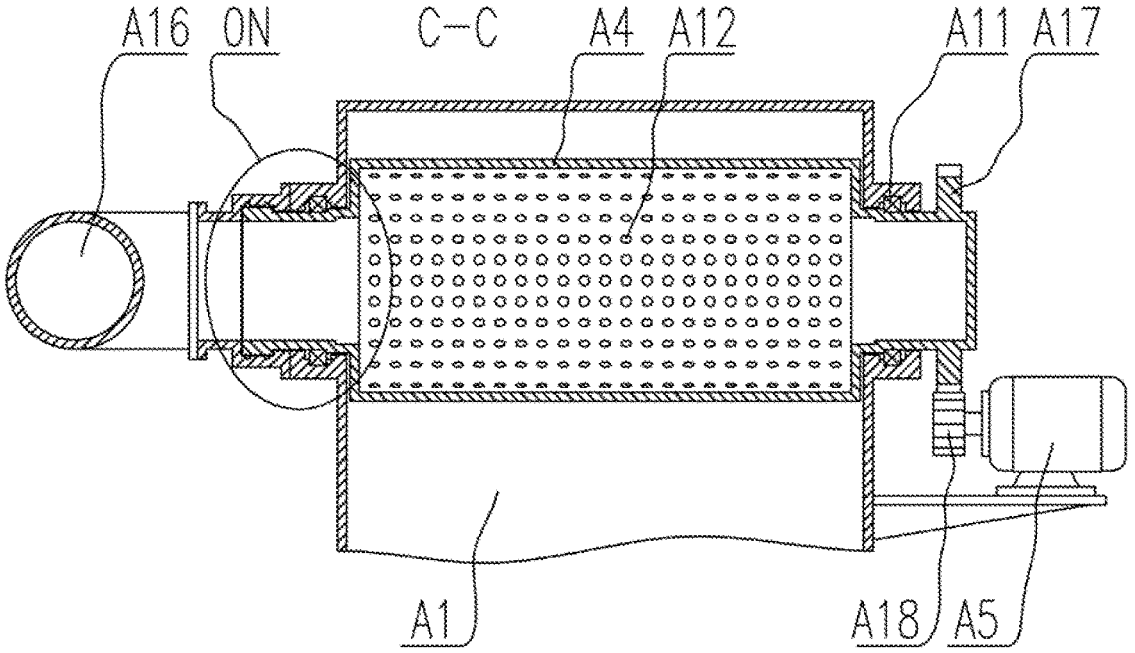
FIG. 5 is a C-C cross-sectional view of FIG. 2.
Figure 6:
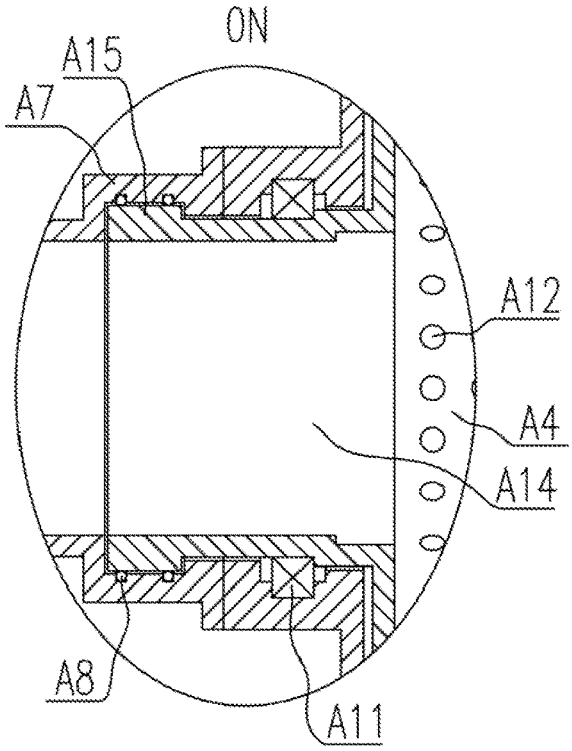
FIG. 6 is a partial enlarged schematic diagram at 0N in FIG. 5.
Figure 7:
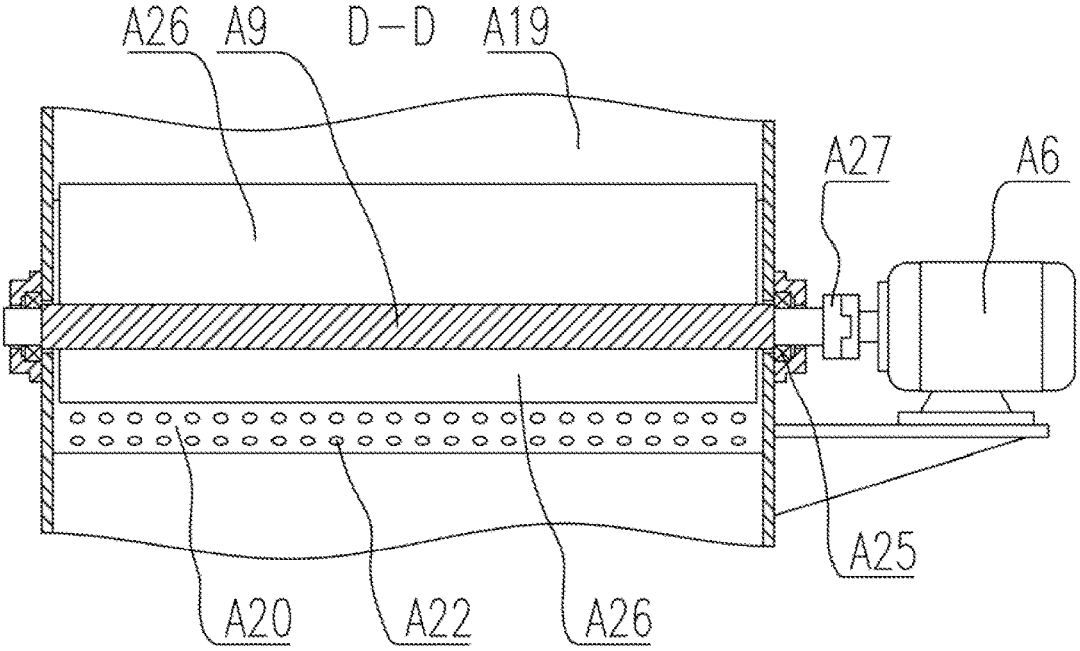
FIG. 7 is a D-D cross-sectional view of FIG. 4.

As shown in FIG. 1, A secondary impurity-removal recycling system for refining cotton comprises a drum impurity-removal mechanism 100, a rods-and-trips impurity-removal mechanism 200 and a linter-cleaning impurity-removal mechanism 300. As shown in FIG. 2, the drum impurity-removal mechanism 100 comprises a first bin shell A1, a first induced draft fan A2, a second induced draft fan A3, a first drum A4, a first motor A5, a second motor A6, a first connecting sleeve A7, a first sealing ring A8 and a first rotary shaft A9. As shown FIG. 5, a first feeding opening A10 is set on the side of the first bin shell A1, in which the first drum A4 is movably installed through a first bearing A11, and the first drum A4 is tube shaped. As shown in FIG. 3, a first mesh A12 is set on the peripheral wall of the first drum A4, and a first scraper A13 is set at the first feeding opening A10 inside the first bin shell A1, opposite the outer peripheral wall of the first drum A4. As shown in FIG. 6, one end of the first drum A4 is provided with a first impurity-discharging pipe A14, the outer periphery of which is provided with a first annular hump A15. The first connecting sleeve A7 is fixedly installed on the outer wall of the first bin shell A1, and the first impurity-discharging pipe A14 is movably stuck in the first connecting sleeve A7 through the first annular hump A15, and communicates with the first connecting sleeve A7. The first sealing ring A8 is fixedly stuck in the first connecting sleeve A7, and encircles the outside of the first annular hump A15. The first induced draft fan A2 communicates with the first connecting sleeve A7 through a first air duct A16, and the first motor A5 is drivingly connected with the first drum A4, as follows. The first motor A5 is fixedly installed on the first bin shell A1. A first gear A17 is set on the other end of the first drum A4, and a second gear A18 is set on the output shaft of the first motor A5, and meshes with the first gear A17. As shown in FIG. 4, a discharging pipe A19 is set at the bottom of the first bin shell A1, and arc plates A20 having the same centre and the same radius are set on the two side walls of the discharging pipe A19, respectively. A impurity-absorbing cavity A21 is set on the outside of the arc plate A20 on one side, and a second mesh A22 communicating with the impurity-absorbing cavity A21 is set on the arc plate A20. An impurity-outlet A23 is set on the outer side wall of the impurity-absorbing cavity A21, and the second induced draft fan A3 is connected to the impurity-outlet A23 through a second air duct A24. As shown in FIG. 7, the first rotary shaft A9 is movably inserted in the discharging pipe A19 through a second bearing A25, and a second scraper A26 is set on the first rotary shaft A9, opposite the inner side wall of the arc plate A20. The second motor A6 is drivingly connected with the first rotary shaft A9, as follows. The second motor A6 is fixedly installed on the discharging pipe A19, and the second motor A6 is drivingly connected with the first rotary shaft A9 through a coupling A27.

Figure 8:
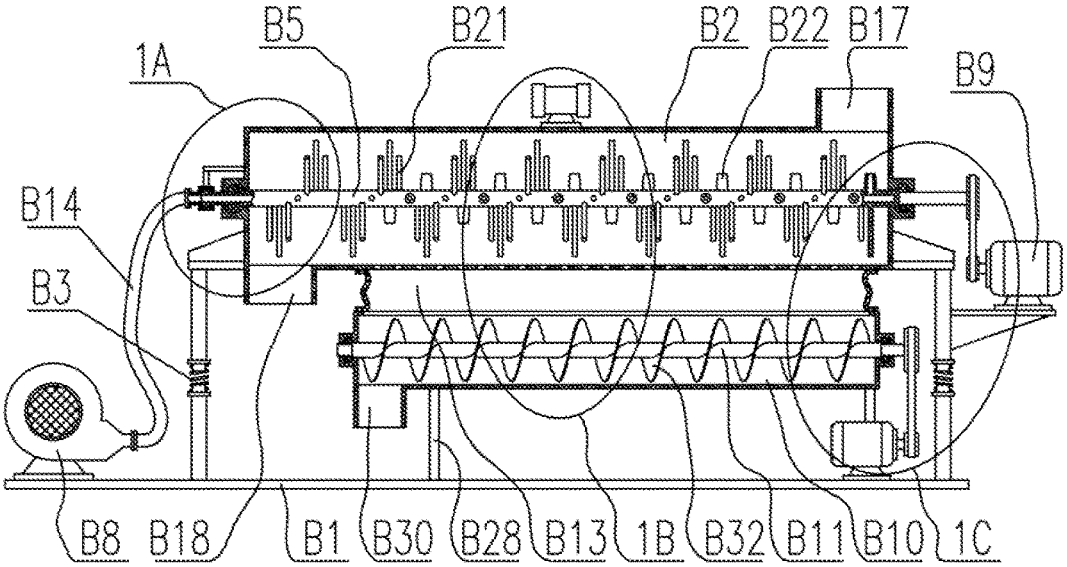
FIG. 8 is a schematic diagram of the rods-and-strips impurity-removal mechanism.
Figure 9:
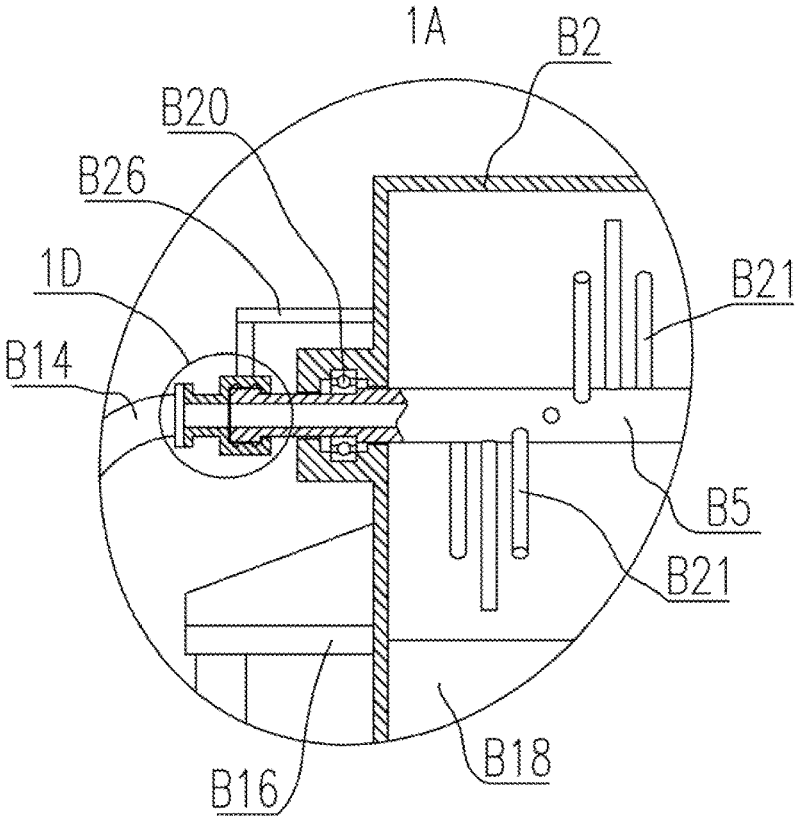
FIG. 9 is a partial enlarged schematic diagram at 1A in FIG. 8.
Figure 10:
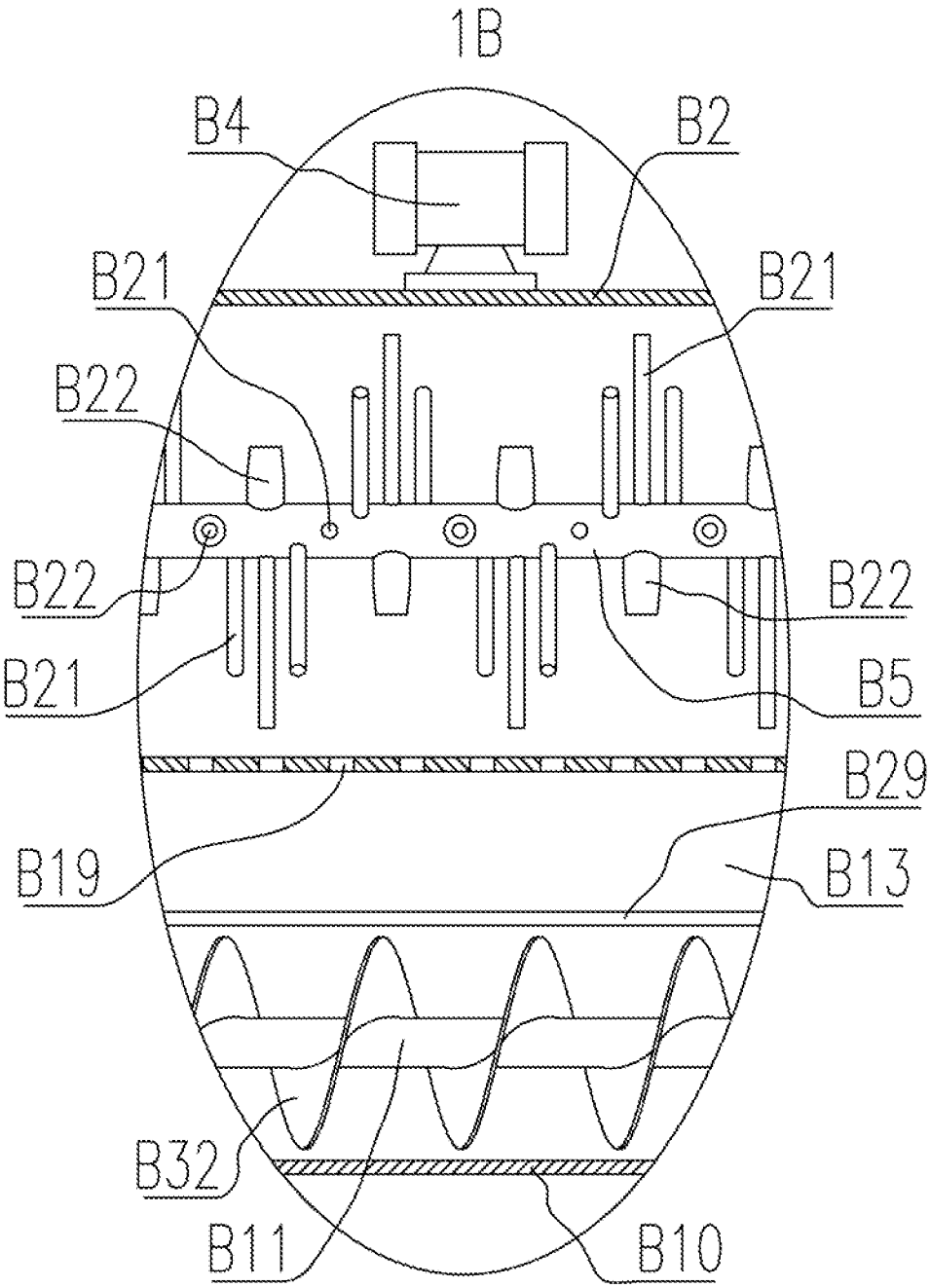
FIG. 10 is a partial enlarged schematic diagram at 1B in FIG. 8.
Figure 11:
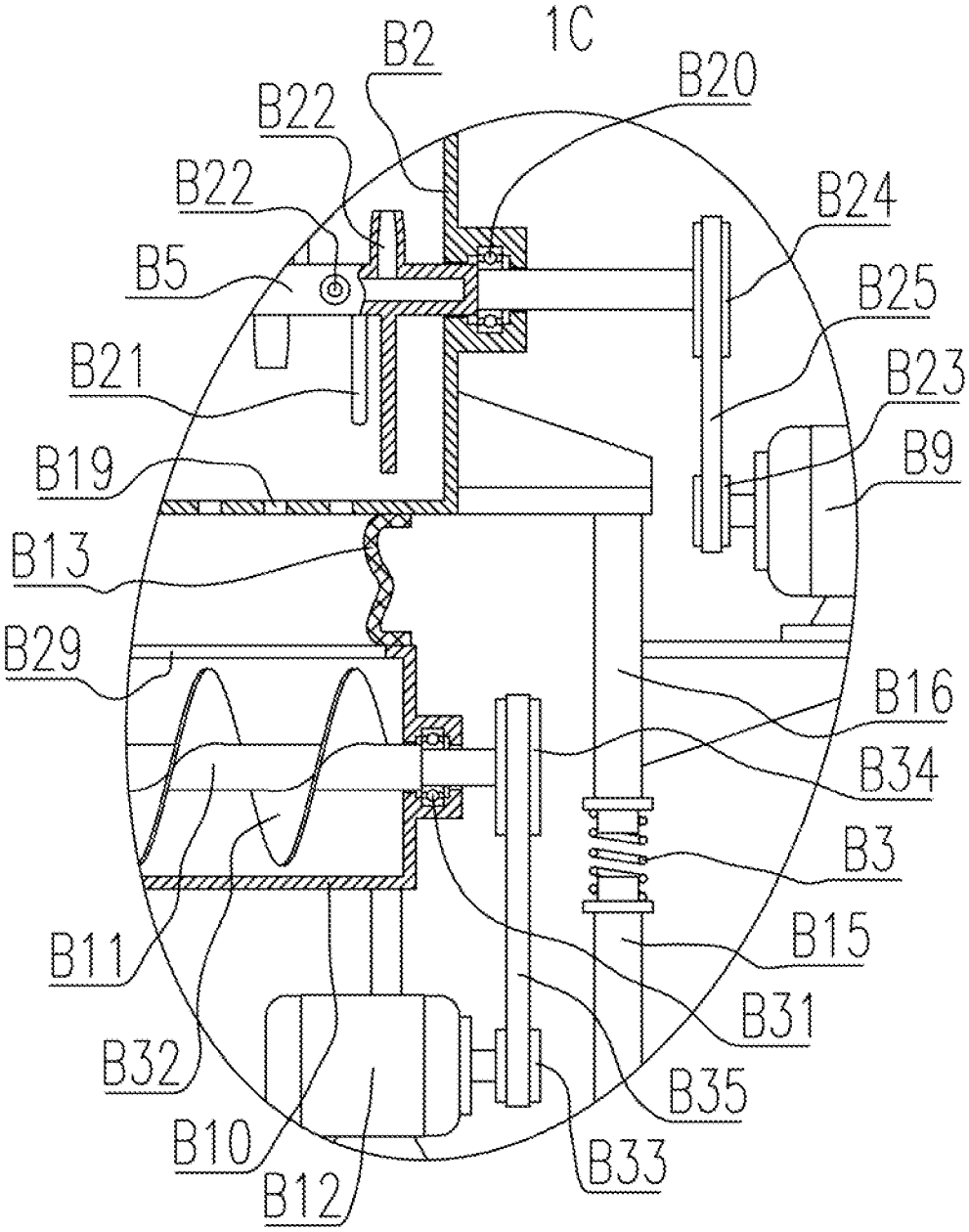
FIG. 11 is a partial enlarged schematic diagram at 1C in FIG. 8.
Figure 12:
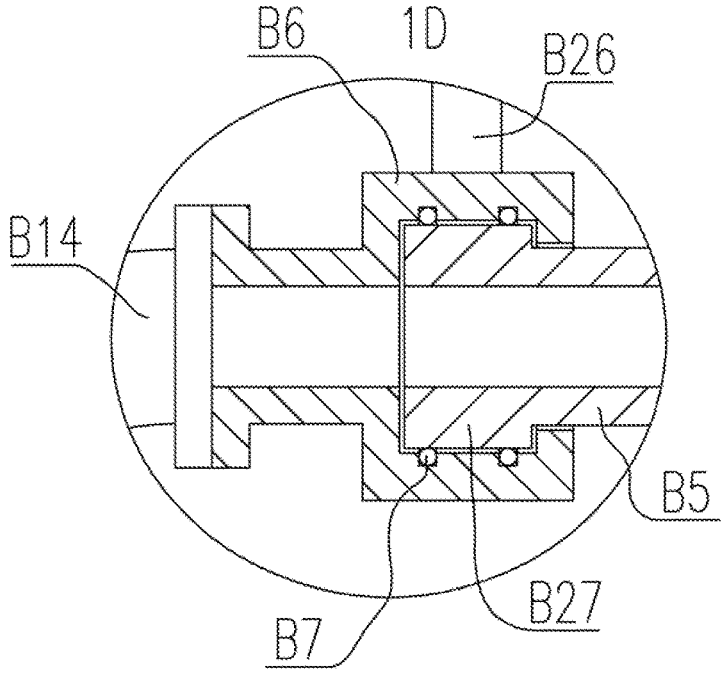
FIG. 12 is a partial enlarged schematic diagram at 1D in FIG. 9.

As shown in FIG. 8, The rods-and-trips impurity-removal mechanism 200 comprises a base B1, a vibrating sieve bin B2, a spring B3, a vibrating motor B4, a hollow axis tube B5, a second connecting sleeve B6, a second sealing ring B7, a high-pressure blower B8, a third motor B9, a hollow body B10, a second rotary shaft B11, a fourth motor B12, a canvas tube B13 and a hose B14. As shown In FIG. 11, a supporting column B15 is set on the base B1, and a supporting frame B16 is set on the vibrating sieve bin B2, and the supporting frame B16 of the vibrating sieve bin B2 is installed on the supporting column B15 through the spring B3. The positional relation between the supporting frame B16, the supporting column B15 and the spring B3 is as follows. The lower end of the spring B3 is fixed on the supporting column B15, and the supporting frame B16 is fixedly set on the upper end of the spring B3. As shown in FIG. 10, the vibrating motor B4 is fixedly installed on the vibrating sieve bin B2, and the vibrating sieve bin B2 is provided with a second feeding opening B17 and a discharging opening B18, and the second feeding opening B17 communicates with the discharging pipe A19 of the drum impurity-removal mechanism 100. Sieving holes B19 are set on the bottom wall of the vibrating sieve bin B2, in which the hollow axis tube B5 is movably inserted through a third bearing B20, and the hollow axis tube B5 located in the vibrating sieve bin B2 is provided with rods-and-trips B21 spirally arranged and a spraying tube B22 communicating with the inside of the hollow axis tube B5. The third motor B9 is fixedly installed on the supporting frame B16, and is drivingly connected to the hollow axis tube B5, as follows. A first belt pulley B23 is set on the output shaft of the third motor B9, and a second belt pulley B24 is set at the end of the hollow axis tube B5, and drivingly connected to the first belt pulley B23 with a belt B25. As shown in FIGS. 9 and 12, the second connecting sleeve B6 is fixedly installed on the vibrating sieve bin B2 through a supporting seat B26. A connecting head B27 communicating with the inside of the hollow axis tube B5 is set on one end of the hollow axis tube B5, and is movably stuck in the second connecting sleeve B6 and communicates with the second connecting sleeve B6. The second sealing ring B7 is fixedly stuck in the second connecting sleeve B6, which encircles the outside of the connecting head B27, and the high-pressure blower B8 is fixedly installed on the base B1, and is connected to the second connecting sleeve B6 through the hose B14. The hollow body B10 is fixedly installed on the base B1 by a supporting rod B28, and is located under the vibrating sieve bin B2, and the top wall of the hollow body B10 is provided with an impurity-inlet B29. The impurity-inlet B29 of the hollow body B10 is connected to the sieving holes B19 of the vibrating sieve bin B2 through the canvas tube B13, and an impurity-discharging opening B30 is set at the bottom of the hollow body B10. The second rotary shaft B11 is movably inserted in the hollow body B10 through a fourth bearing B31, and a spiral rib plate B32 is set on the second rotary shaft B11 located in the hollow body B10. The fourth motor B12 is fixedly installed on the base B1, and is drivingly connected with the second rotary shaft B11, as follows. A third belt pulley B33 is set on the output shaft of the fourth motor B12, and a fourth belt pulley B34 is set at the end of the second rotary shaft B11, and is belt-drivingly connected to the third belt pulley B33 with a belt B35.

Figure 13:
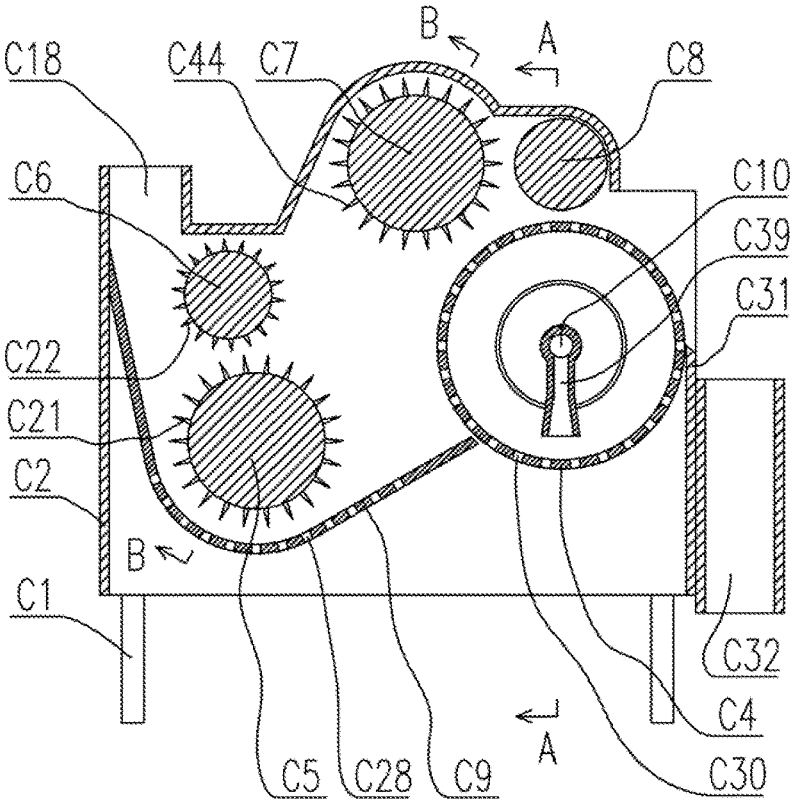
FIG. 13 is a schematic diagram of the linter-cleaning impurity-removal mechanism.
Figure 14:
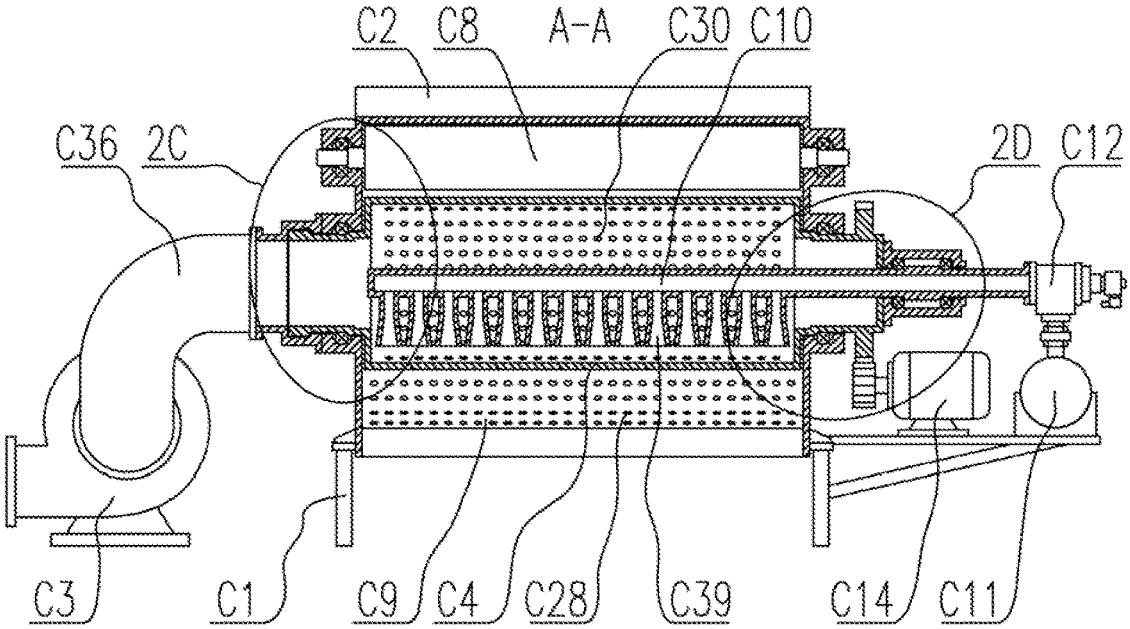
FIG. 14 is an A-A cross-sectional view of FIG. 13.
Figure 15:
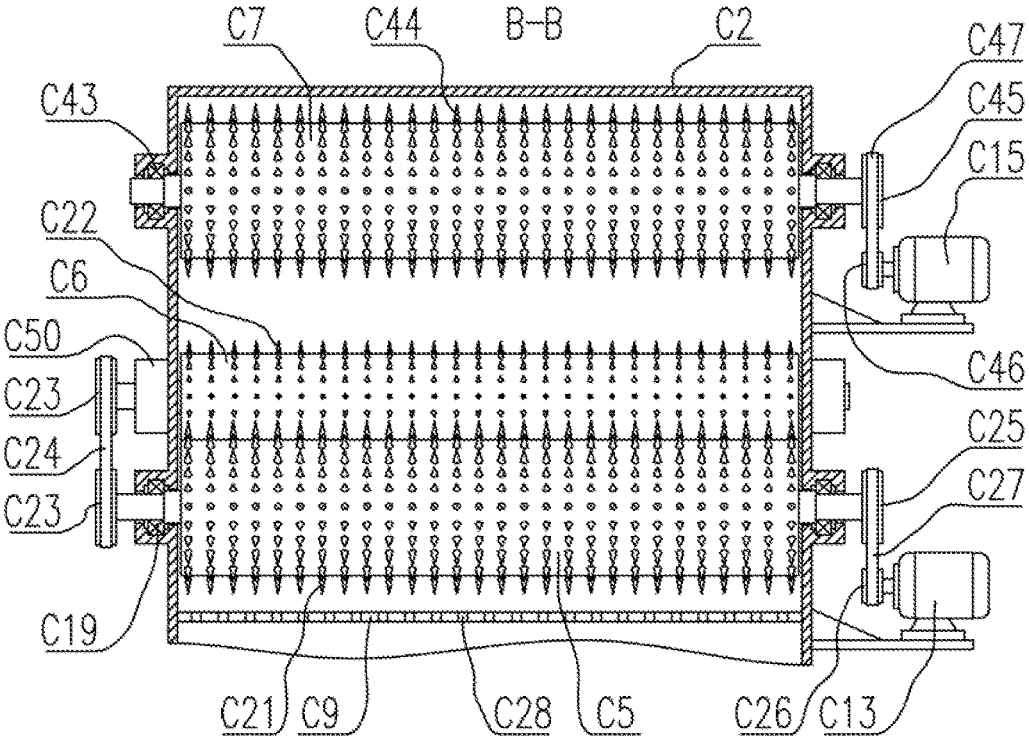
FIG. 15 is a B-B cross-sectional view of FIG. 13.
Figure 16:
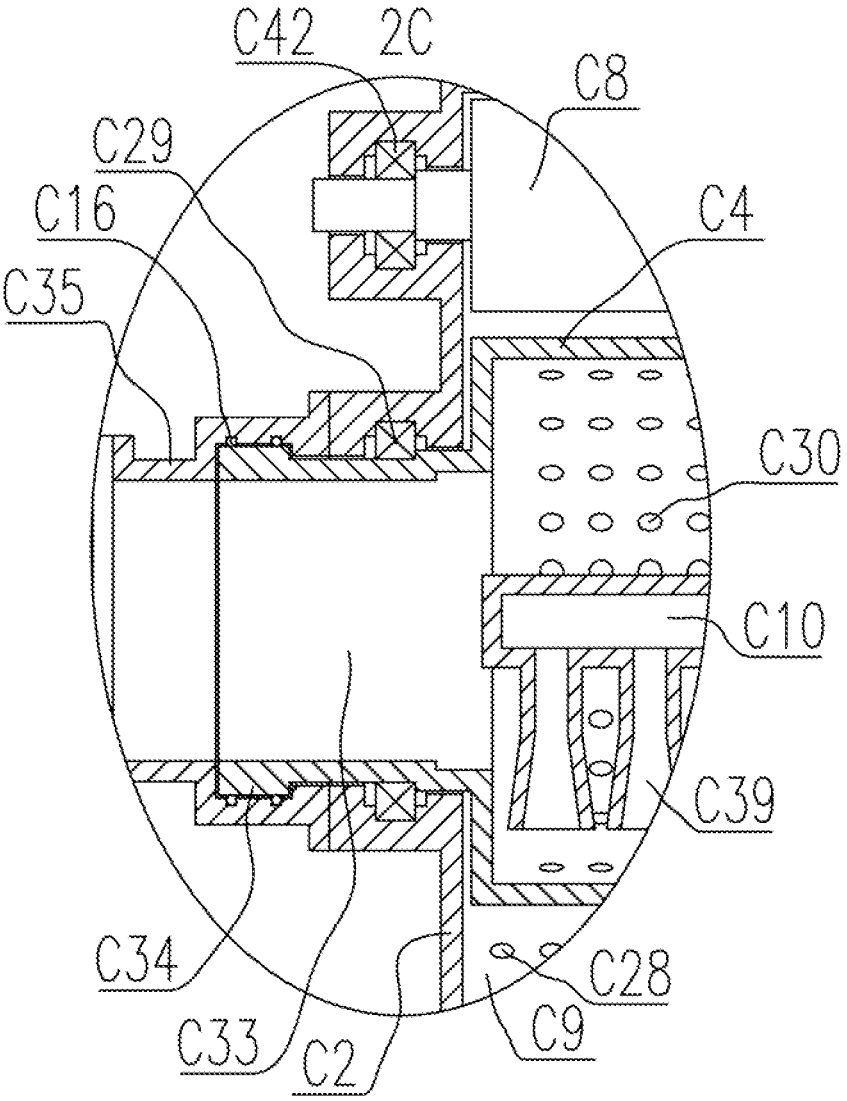
FIG. 16 is a partial enlarged schematic diagram at 2C in FIG. 14.
Figure 17:
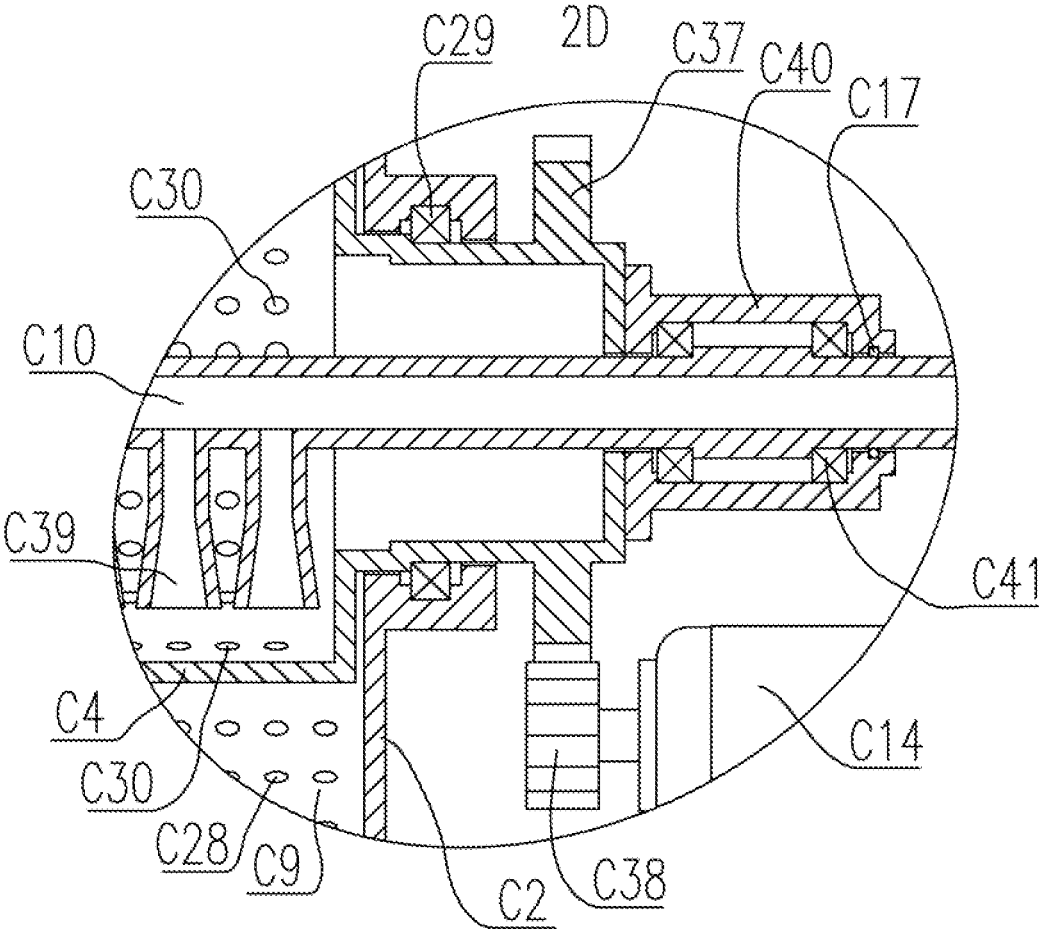
FIG. 17 is a partial enlarged schematic diagram at 2D in FIG. 14.

As shown in FIGS. 13 and 14, The linter-cleaning impurity-removal mechanism 300 comprises a frame C1, a second bin shell C2, a third induced draft fan C3, a second drum C4, a first licker-in C5, a second licker-in C6, a third licker-in C7, a pressuring roller C8, a bottom plate C9, a blowing pipe C10, a high-pressure air bag C11, a pulse valve C12, a fifth motor C13, a sixth motor C14, a seventh motor C15, a third connecting sleeve C35, a third sealing ring C16 and a fourth sealing ring C17. The second bin shell C2 is fixedly installed on the frame C1, and the bottom and the rear of the second bin shell C2 are open. A third feeding opening C18 is set on the top wall of the front of the second bin shell C2, and communicates with the discharging opening B18 of the rods-and-trips impurity-removal mechanism 200. The first licker-in C5 and the second licker-in C6 are movably installed in the second bin shell C2 through a fifth bearing C19 and a sixth bearing C50, respectively, and the second licker-in C6 is located at the third feeding opening C18 of the second bin shell C2. A first spike C21 and a second spike C22 are set on the periphery of the first licker-in C5 and the second licker-in C6, respectively. The fifth motor C13 is drivingly connected with the first licker-in C5 and the second licker-in C6, respectively, as follows. As shown in FIG. 15, a fifth belt pulley C23 is set at one end of the first licker-in C5 and the second licker-in C6, respectively. The first licker-in C5 is belt-drivingly connected to the second licker-in C6 through the fifth belt pulley C23 with a belt C24. The fifth motor C13 is fixedly installed on the second bin shell C2. A sixth belt pulley C25 is set on the other end of the first licker-in C5, and a seventh belt pulley C26 is set and the output shaft of the fifth moto C13, and is drivingly connected to the sixth belt pulley C25 with a belt C27. The bottom plate C9 is fixedly installed in the second bin shell C2 and is located under the first licker-in C5, and the bottom plate C9 is provided with impurity-leaking holes C28. The second drum C4 is movably installed in the second bin shell C4 through a seventh bearing C29, and is tube shaped, and impurity-absorbing holes C30 are set on the peripheral wall of the second drum C4. A third scraper C31 opposite the outer peripheral wall of the second drum C4 is set at the rear of the second bin shell C2, and a discharging hopper C32 is set at the third scraper C31. As shown in FIG. 16, a second impurity-discharging pipe C33 is set at one end of the second drum C4, and a second annular hump C34 is set on the outer periphery of the second impurity-discharging pipe C33. The third connecting sleeve C35 is fixedly installed on the outer wall of the second bin shell C2, and the second impurity-discharging pipe C33 is movably stuck in the third connecting sleeve C35 through the second annular hump C34, and communicates with the third connecting sleeve C35. The third induced draft fan C3 communicates with the third connecting sleeve C35 through a third air duct C36, and the sixth motor C14 is in drivingly connected with the second drum C4. The third sealing ring C16 is fixedly stuck in the third connecting sleeve C35 and encircles the outside of the second annular hump C34. The transmission relation between the sixth motor C14 and the second drum C4 is as follows. The sixth motor C14 is fixedly installed on the frame C1. A third gear C37 is set on the other end of the second drum C4, and a fourth gear C38 is set on the output shaft of the sixth motor C14, and meshes with the third gear C37. As shown in FIG. 14, the high-pressure gas bag C11 is fixedly installed on the frame C1, and the pulse valve C12 is fixedly installed on the high-pressure gas bag C11 and communicates with the high-pressure gas bag C11. The blowing pipe C10 communicates with the pulse valve C12, and is inserted in the second drum C4, and a spraying nozzle C39 opposite the impurity-absorbing holes C30 is set on the blowing pipe C10 located in the second drum C4. The connection relation between the blowing pipe C10 and the second drum C4 is as follows. As show in FIG. 17, A pipe sleeve C40 is set on the second drum C4, and the blowing pipe C10 is movably inserted through the pipe sleeve C40 and the second drum C4 through a tenth bearing C41. The fourth sealing ring C17 is fixedly stuck in the pipe sleeve C40 and encircles the outside of the blowing pipe Cl0. The pressing roller C8 is movably installed in the second bin shell C2 through an eighth bearing C42 and located above the second drum C4, and the third licker-in C7 is movably installed in the second bin shell C2 through a ninth bearing C43 and located diagonally above the second drum C4. A third spike C44 is set on the periphery of the third licker-in C7, and the seventh motor C15 is drivingly connected with the third licker-in C7, as follows. As shown in FIG. 15, an eighth belt pulley C45 is set at one end of the third licker-in C7, and the seventh motor C15 is fixedly installed on the second bin shell C2. A ninth belt pulley C46 is set on the output shaft of the seventh motor C15, and belt-drivingly connected to the eighth belt pulley C45 with a belt C47.

The following part shows how the secondary impurity-removal recycling system for refining cotton operates. The cotton linters that need to be purified enter the first bin shell A1 of the drum improves-removal mechanism 100 from the first feeding opening A10, and are adsorbed on the outer peripheral wall of the first drum A4 by the first induced draft fan A2. The impurities in the cotton linters are sucked into the first drum A4 through the first mesh A12, and are discharged through the first impurity-discharging pipe A14, the first connecting sleeve A7, the first air duct A16 and the first induced draft fan A2. The first drum A4 is driven to rotate counterclockwise in FIG. 2 by the first motor A5, During rotation, the cotton linters absorbed on the outer peripheral wall of the first drum A4 are scraped off by the first scraper A13, and drop into the discharging pipe A19. The second motor A6 drives the first rotary shaft A9 to rotate clockwise in FIG. 2, and the cotton linters are pushed to one side of the arc plate A20 with the second mesh A22 by the second scraper A26 on the first rotary shaft A9. The cotton linters are adsorbed on the arc plate A20 by the second induced draft fan A3, so the impurities in the cotton linters are sucked into the impurity-absorbing cavity A21 through the second mesh A22 and discharged through the impurity-outlet A23, the second air duct A24 and the second induced draft fan A3. Then, while the second scraper A26 continues rotating, the cotton linters absorbed on the arc plate A20 are scraped off and discharged from the discharging pipe A19 into the vibrating sieve bin B2 of the rods-and trips impurity-removal mechanism 200 through the second feeding opening B17. The hollow axis tube B5 is driven to rotate by the third motor B9 to break and disperse the cotton linters by the rods-and-strips B21 on the hollow axis tube B5, at the same time, high-pressure air is blown into the hollow axis tube B5 through the high-pressure blower B8, and is sprayed from the spraying tube B22 to blow away the cotton linters, so that the impurities in the cotton linters are scattered. Then, the vibrating motor B4 drives the vibrating sieve bin B2 to sieve, so the impurities in the cotton linters are vibrated down from the sieving holes B19, and fall into the hollow body B10 through the canvas tube B13 and the impurity-inlet B29. The second rotary shaft B11 is driven to rotate by the fourth motor B12, and the impurities in the hollow body B10 are delivered by the spiral rib plate B32 on the second rotary shaft B11 and discharged from the impurity-discharging opening B30. Since the rods-and-trips B21 on the hollow axis tube B5 are arranged in a spiral, when the hollow axis tube B5 rotates, the cotton linters can be delivered through the rods-and-trips B21, so that the cotton linters after being purified are discharged from the discharging opening B18 into the second bin shell C2 of the linter-cleaning impurity-removal mechanism 300 through the third feeding opening C18. The first licker-in C5 and the second licker-in C6 are driven to rotate counterclockwise in FIG. 13 by the fifth motor C13, The cotton linters are shredded and scattered by the first spike C21 and the second spike C22 on the first licker-in C5 and the second licker-in C6. While the second drum C4 is driven to rotate by the sixth motor C14, exhaust air is performed by the third induced draft fan C3, then a negative pressure is generated in the second drum C4 to absorb the cotton linters in the second bin shell C2 onto the outer peripheral wall of the drum C4. The impurities in the cotton linters enter the second drum C4 through the impurity-absorbing holes C30, and are discharged through the third air duct C36 and the third induced draft fan C3. The cotton linters adsorbed on the second drum C4 are compressed by the pressing roller C8, then the third scraper C31 scrapes them from the second drum C4 into the discharging hopper C32, thus finishing the impurity-removal process. In the process of removing impurities, the third licker-in C7 is driven to rotate clockwise in FIG. 13 by the seventh motor C15. The third spike C44 on the third licker-in C7 strips the cotton linters absorbed on the second drum C4 to maintain a certain thickness of the cotton layer on the second drum C4 to avoid inability to effectively remove the impurities in the outer cotton layer for too thick cotton layer, which greatly improves the impurity-removal effect, and significantly reduces the impurity content in the cotton linters after impurity-removal. When the impurity-absorbing holes C30 of the second drum C4 need to be cleaned, the high-pressure air bag C11 is connected to the air source to store compressed air in the high-pressure air bag C11. Then the pulse valve C12 is opened, the compressed air is sprayed out through the blowing pipe C10 and the spraying nozzle C39, to backwards blow the impurity-absorbing holes C30, so that there is no need for manual cleaning.

What is claimed is:

1. An impurity-removal recycling system for refining cotton, comprising a drum impurity-removal mechanism (100), an impurity-removal mechanism (200) using rods and a linter-cleaning impurity-removal mechanism (300), the drum impurity-removal mechanism (100) comprises a first bin shell (A1), a first induced draft fan (A2), a second induced draft fan (A3), a first drum (A4), a first motor (A5), a second motor (A6), a first connecting sleeve (A7) and a first rotary shaft (A9), a first feeding opening (A10) is configured at a side of the first bin shell (A1), in which the first drum (A4) is movably installed, and the first drum (A4) is tube-shaped, a first mesh (Al2) is configured on a peripheral wall of the first drum (A4), and a first scraper (A13) is configured at the first feeding opening (A10) inside the first bin shell (A1), one end of the first scraper (A13) is adjacent to an outer peripheral wall of the first drum (A4), one end of the first drum (A4) is provided with a first impurity-discharging pipe (A14), an outer periphery of the first impurity-discharging pipe (A14) is provided with a first annular hump (A15), the first connecting sleeve (A7) is fixedly installed on an outer wall of the first bin shell (A1), and the first impurity-discharging pipe (A14) is movably mounted in the first connecting sleeve (A7) by the first annular hump (A15), and fluidly communicates with the first connecting sleeve (A7), the first induced draft fan (A2) fluidly communicates with the first connecting sleeve (A7) through a first air duct (A16), and the first motor (A5) is connected with the first drum (A4), a discharging pipe (A19) is set at a bottom of the first bin shell (A1), and arc plates (A20) having a same center of circle and a same radius are configured on two side walls of the discharging pipe (A19), a impurity-absorbing cavity (A21) is configured on an outside of the arc plate (A20) on one side, and a second mesh (A22) fluidly communicating with the impurity-absorbing cavity (A21) is configured on the arc plate (A20), an impurity-outlet (A23) is set on an outer side wall of the impurity-absorbing cavity (A21), and the second induced draft fan (A3) is connected to the impurity-outlet (A23) through a second air duct (A24), the first rotary shaft (A9) is movably inserted in the discharging pipe (A19), and a second scraper (A26) is configured on the first rotary shaft (A9), one end of the second scraper (A26) is adjacent to an inner side wall of the arc plate (A20), the second motor (A6) is connected with the first rotary shaft (A9), impurity-removal mechanism (200) using rods comprises a base (B1), a vibrating sieve bin (B2), a spring (B3), a vibrating motor (B4), a hollow axis tube (B5), a second connecting sleeve (B6), a second sealing ring (B7), a high-pressure blower (B8), a third motor (B9), a hollow body (B10), a second rotary shaft (B11), a fourth motor (B12), a canvas tube (B13) and a hose (B14), a supporting column (B15) is configured on the base (B1), and a supporting frame (B16) is configured on the vibrating sieve bin (B2), and the supporting frame (B16) of the vibrating sieve bin (B2) is installed on the supporting column (B15) through the spring (B3), the vibrating motor (B4) is fixedly installed on the vibrating sieve bin (B2), and the vibrating sieve bin (B2) is provided with a second feeding opening (B17) and a discharging opening (B18), and the second feeding opening (B17) fluidly communicates with the discharging pipe (A19) of the drum impurity-removal mechanism (100), sieving holes (B19) are configured on a bottom wall of the vibrating sieve bin (B2), in which the hollow axis tube (B5) is movably inserted, and the hollow axis tube (B5) located in the vibrating sieve bin (B2) is provided with spirally arranged rods (B21) and a spraying tube (B22) fluidly communicating with an inside of the hollow axis tube (B5), the third motor (B9) is fixedly installed on a supporting frame (B16), and is connected to the hollow axis tube (B5), the second connecting sleeve (B6) is fixedly installed on the vibrating sieve bin (B2), a connecting head (B27) fluidly communicating with an inside of the hollow axis tube (B5) is spirally arranged on one end of the hollow axis tube (B5), and is movably mounted in the second connecting sleeve (B6) and fluidly communicates with the second connecting sleeve (B6), the second sealing ring (B7) is fixed in the second connecting sleeve (B6), the second sealing ring (B7) encircles an outside of the connecting head (B27), and the high-pressure blower (B8) is fixedly installed on the base (B1), and is connected to the second connecting sleeve (B6), the hollow body (B10) is fixedly installed on the base (B1), and is located under the vibrating sieve bin (B2), and a top wall of the hollow body (B10) is provided with an impurity-inlet (B29), the impurity-inlet (B29) of the hollow body (B10) is connected to the sieving holes (B19) of the vibrating sieve bin (B2) through the canvas tube (B13), and an impurity-discharging opening (B30) is configured at a bottom of the hollow body (B10), the second rotary shaft (B11) is movably inserted in the hollow body (B10), and a spiral rib plate (B32) is set on the second rotary shaft (B11) located in the hollow body (B10), the fourth motor (B12) is fixedly installed on the base (B1), and is connected with the second rotary shaft (B11), the linter-cleaning impurity-removal mechanism (300) comprises a frame (C1), a second bin shell (C2), a third induced draft fan (C3), a second drum (C4), a first licker-in (C5), a second licker-in (C6), a third licker-in (C7), a pressuring roller (C8), a bottom plate (C9), a pipe (C10), a high-pressure air bag (C11), a pulse valve (C12), a fifth motor (C13), a sixth motor (C14), a seventh motor (C15) and a third connecting sleeve (C35), the second bin shell (C2) is fixedly installed on the frame (C1), and a bottom and a rear of the second bin shell (C2) are open, a third feeding opening (C18) is configured on a top wall of a front of the second bin shell (C2), and fluidly communicates with the discharging opening (B18) of the impurity-removal mechanism (200) using rods, the first licker-in (C5) and the second licker-in (C6) are movably installed in the second bin shell (C2), and the second licker-in (C6) is located at the third feeding opening (C18) of the second bin shell (C2), a first spike (C21) and a second spike (C22) are configured on a periphery of the first licker-in (C5) and the second licker-in (C6), the fifth motor (C13) is connected with the first licker-in (C5) and the second licker-in (C6), the bottom plate (C9) is fixedly installed in the second bin shell (C2) and is located under the first licker-in (C5), and the bottom plate (C9) is provided with impurity-leaking holes (C28), the second drum (C4) is movably installed in the second bin shell (C4), and is tube-shaped, and impurity-absorbing holes (C30) are set in a peripheral wall of the second drum (C4), one end of a third scraper (C31) adjacent to the peripheral wall of the second drum (C4) is configured at a rear of the second bin shell (C2), and a discharging hopper (C32) is set at the third scraper (C31), a second impurity-discharging pipe (C33) is configured at one end of the second drum (C4), and a second annular hump (C34) is set on an outer periphery of the second impurity-discharging pipe (C33), the third connecting sleeve (C35) is fixedly installed on an outer wall of the second bin shell (C2), and the second impurity-discharging pipe (C33) is movably mounted in the third connecting sleeve (C35) by the second annular hump (C34), and fluidly communicates with the third connecting sleeve (C35), the third induced draft fan (C3) fluidly communicates with the third connecting sleeve (C35) through a third air duct (C36), and the sixth motor (C14) is in connected with the second drum (C4), the high-pressure gas bag (C11) is fixedly installed on the frame (C1), and the pulse valve (C12) is fixedly installed on the high-pressure gas bag (C11) and fluidly communicates with the high-pressure gas bag (C11), the pipe (C10) fluidly communicates with the pulse valve (C12), and is inserted in the second drum (C4), and a spraying nozzle (C39) corresponding to the impurity-absorbing holes (C30) is configured on the pipe (C10) located in the second drum (C4), the pressing roller (C8) is movably installed in the second bin shell (C2) and located above the second drum (C4), and the third licker-in (C7) is movably installed in the second bin shell (C2) and located diagonally above the second drum (C4), a third spike (C44) is configured on a periphery of the third licker-in (C7), and the seventh motor (C15) is connected with the third licker-in (C7).

2. The impurity-removal recycling system for refining cotton according to claim 1, wherein, the drum impurity-removal mechanism (100) further comprises a first sealing ring (A8), the first sealing ring (A8) is fixed in the first connecting sleeve (A7) and encircles an outside of the first annular hump (A15).

3. The impurity-removal recycling system for refining cotton according to claim 1, wherein the first drum (A4) is movably installed in the first bin shell (A1) through a first bearing (A11), the first motor (A5) is fixedly installed on the first bin shell (A1), a first gear (A17) is configured on the other end of the first drum (A4), and a second gear (A18) is configured on an output shaft of the first motor (A5), and meshes with the first gear (A17), the first rotary shaft (A9) is movably inserted in the discharging pipe (A19) through a second bearing (A25), the second motor (A6) is fixedly installed on the discharging pipe (A19), and the second motor (A6) is connected with the first rotary shaft (A9) through a coupling (A27).

4. The impurity-removal recycling system for refining cotton according to claim 2, wherein, the first drum (A4) is movably installed in the first bin shell (A1) through a first bearing (A11), the first motor (A5) is fixedly installed on the first bin shell (A1), a first gear (A17) is configured on the other end of the first drum (A4), and a second gear (A18) is configured on an output shaft of the first motor (A5), and meshes with the first gear (A17), the first rotary shaft (A9) is movably inserted in the discharging pipe (A19) through a second bearing (A25), the second motor (A6) is fixedly installed on the discharging pipe (A19), and the second motor (A6) is connected with the first rotary shaft (A9) through a coupling (A27).

5. The impurity-removal recycling system for refining cotton according to claim 1, wherein, the hollow axis tube (B5) is movably inserted in the vibrating sieve bin (B2) through a third bearing (B20), a first belt pulley (B23) is configured on an output shaft of the third motor (B9), and a second belt pulley (B24) is configured at the one end of the hollow axis tube (B5), and connected to the first belt pulley (B23) with a belt (B25), the second rotary shaft (B11) is movably inserted in the hollow body (B10) through a fourth bearing (B31), a third belt pulley (B33) is configured on an output shaft of the fourth motor (B12), and a fourth belt pulley (B34) is configured at an end of the second rotary shaft (B11), and is connected to the third belt pulley (B33) with a belt (B35).

6. The impurity-removal recycling system for refining cotton according to claim 2, wherein, the hollow axis tube (B5) is movably inserted in the vibrating sieve bin (B2) through a third bearing (B20), a first belt pulley (B23) is configured on an output shaft of the third motor (B9), and a second belt pulley (B24) is configured at the one end of the hollow axis tube (B5), and connected to the first belt pulley (B23) with a belt (B25), the second rotary shaft (B11) is movably inserted in the hollow body (B10) through a fourth bearing (B31), a third belt pulley (B33) is configured on an output shaft of the fourth motor (B12), and a fourth belt pulley (B34) is configured at an end of the second rotary shaft (B11), and is connected to the third belt pulley (B33) with a belt (B35).

7. The impurity-removal recycling system for refining cotton according to claim 1, wherein, a lower end of the spring (B3) is fixed on the supporting column (B15), and the supporting frame (B16) is fixedly configured on an upper end of the spring (B3).

8. The impurity-removal recycling system for refining cotton according to claim 2, wherein, a lower end of the spring (B3) is fixed on the supporting column (B15), and the supporting frame (B16) is fixedly configured on an upper end of the spring (B3).

9. The impurity-removal recycling system for refining cotton according to claim 1, wherein, the second connecting sleeve (B6) is fixedly installed on the vibrating sieve bin (B2) by a supporting seat (B26), and the hollow body (B10) is fixedly installed on the base (B1) by a supporting rod (B28).

10. The impurity-removal recycling system for refining cotton according to claim 2, wherein, the second connecting sleeve (B6) is fixedly installed on the vibrating sieve bin (B2) by a supporting seat (B26), and the hollow body (B10) is fixedly installed on the base (B1) by a supporting rod (B28).

11. The impurity-removal recycling system for refining cotton according to claim 1, wherein, the first licker-in (C5) and the second licker-in (C6) are movably installed in the second bin shell (C2) through a fifth bearing (C19) and a sixth bearing (C50), a fifth belt pulley (C23) is configured at one end of the first licker-in (C5) and the second licker-in (C6), the first licker-in (C5) is connected to the second licker-in (C6) through the fifth belt pulley (C23) with a belt (C24), the fifth motor (C13) is fixedly installed on the second bin shell (C2), a sixth belt pulley (C25) is configured on the other end of the first licker-in (C5), and a seventh belt pulley (C26) is configured at an output shaft of the fifth motor (C13), and is connected to the sixth belt pulley (C25) with a belt (C27), the second drum (C4) is movably installed in the second bin shell (C2) through a seventh bearing (C29), the sixth motor (C14) is fixedly installed on the frame (C1), a third gear (C37) is configured on the other end of the second drum (C4), and a fourth gear (C38) is configured on an output shaft of the sixth motor (C14), and meshes with the third gear (C37), the pressing roller (C8) is movably installed in the second bin shell (C2) through an eighth bearing (C42), the third licker-in (C7) is movably installed in the second bin shell (C2) through a ninth bearing (C43), an eighth belt pulley (C45) is configured at one end of the third licker-in (C7), and the seventh motor (C15) is fixedly installed on the second bin shell (C2), a ninth belt pulley (C46) is configured on an output shaft of the seventh motor (C15), and connected to the eighth belt pulley (C45) with a belt (C47).

12. The impurity-removal recycling system for refining cotton according to claim 2, wherein, the first licker-in (C5) and the second licker-in (C6) are movably installed in the second bin shell (C2) through a fifth bearing (C19) and a sixth bearing (C50), a fifth belt pulley (C23) is configured at one end of the first licker-in (C5) and the second licker-in (C6), the first licker-in (C5) is connected to the second licker-in (C6) through the fifth belt pulley (C23) with a belt (C24), the fifth motor (C13) is fixedly installed on the second bin shell (C2), a sixth belt pulley (C25) is configured on the other end of the first licker-in (C5), and a seventh belt pulley (C26) is configured at an output shaft of the fifth motor (C13), and is connected to the sixth belt pulley (C25) with a belt (C27), the second drum (C4) is movably installed in the second bin shell (C2) through a seventh bearing (C29), the sixth motor (C14) is fixedly installed on the frame (C1), a third gear (C37) is configured on the other end of the second drum (C4), and a fourth gear (C38) is configured on an output shaft of the sixth motor (C14), and meshes with the third gear (C37), the pressing roller (C8) is movably installed in the second bin shell (C2) through an eighth bearing (C42), the third licker-in (C7) is movably installed in the second bin shell (C2) through a ninth bearing (C43), an eighth belt pulley (C45) is configured at one end of the third licker-in (C7), and the seventh motor (C15) is fixedly installed on the second bin shell (C2), a ninth belt pulley (C46) is configured on an output shaft of the seventh motor (C15), and connected to the eighth belt pulley (C45) with a belt (C47).

13. The impurity-removal recycling system for refining cotton according to claim 1, wherein, the linter-cleaning impurity-removal mechanism (300) further comprises a third sealing ring (C16) and a fourth sealing ring (C17), the third sealing ring (C16) is fixed in the third connecting sleeve (C35) and encircles an outside of the second annular hump (C34), a pipe sleeve (C40) is configured on the second drum (C4), and the pipe (C10) is movably inserted through the pipe sleeve (C40) and the second drum (C4) by a tenth bearing (C41), the fourth sealing ring (C17) is fixed stuck in the pipe sleeve (C40) and encircles an outside of the pipe (C10).

14. The impurity-removal recycling system for refining cotton according to claim 2, wherein, the linter-cleaning impurity-removal mechanism (300) further comprises a third sealing ring (C16) and a fourth sealing ring (C17), the third sealing ring (C16) is fixed in the third connecting sleeve (C35) and encircles an outside of the second annular hump (C34), a pipe sleeve (C40) is configured on the second drum (C4), and the pipe (C10) is movably inserted through the pipe sleeve (C40) and the second drum (C4) by a tenth bearing (C41), the fourth sealing ring (C17) is fixed in the pipe sleeve (C40) and encircles an outside of the pipe (C10).

* * * * *